US009046799B2

(12) United States Patent
Kmiecik-Lawrynowicz et al.

(10) Patent No.: US 9,046,799 B2
(45) Date of Patent: Jun. 2, 2015

(54) CLEAR TONER COMPOSITION

(71) Applicant: Xerox Corporation, Norwalk, CT (US)

(72) Inventors: Grazyna E. Kmiecik-Lawrynowicz, Fairport, NY (US); Maura A. Sweeney, Irondequoit, NY (US); Robert D. Bayley, Fairport, NY (US); Witold J. Lawrynowicz, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 103 days.

(21) Appl. No.: 13/864,264

(22) Filed: Apr. 17, 2013

(65) Prior Publication Data

US 2014/0315123 A1 Oct. 23, 2014

(51) Int. Cl.
*G03G 9/087* (2006.01)
*G03G 9/08* (2006.01)

(52) U.S. Cl.
CPC ..... *G03G 9/0821* (2013.01); *G03G 9/0804* (2013.01); *G03G 9/08782* (2013.01)

(58) Field of Classification Search
CPC ..... G03G 9/08773; G03G 9/08782; G03G 9/08788
See application file for complete search history.

(56) References Cited

U.S. PATENT DOCUMENTS

| | | | | |
|---|---|---|---|---|
| 7,306,886 | B2 | 12/2007 | Herman et al. | |
| 7,316,881 | B2 | 1/2008 | Rimai et al. | |
| 7,318,987 | B2 | 1/2008 | Simpson et al. | |
| 7,320,851 | B2 | 1/2008 | Zhou et al. | |
| 7,344,813 | B2 | 3/2008 | Sweeney et al. | |
| 7,354,687 | B2 | 4/2008 | Stulc et al. | |
| 7,687,218 | B2 | 3/2010 | Yang et al. | |
| 7,759,038 | B2 | 7/2010 | Yamazaki et al. | |
| 7,785,763 | B2 | 8/2010 | Agur et al. | |
| 7,803,508 | B2 | 9/2010 | Ishii et al. | |
| 7,811,734 | B2 | 10/2010 | Ogawa et al. | |
| 7,858,279 | B2 | 12/2010 | Halfyard et al. | |
| 7,862,973 | B2 | 1/2011 | Nakayama et al. | |
| 7,955,773 | B2 | 6/2011 | Sakai et al. | |
| 2008/0170896 | A1 * | 7/2008 | Kubota et al. | 399/340 |

* cited by examiner

*Primary Examiner* — Peter Vajda
(74) *Attorney, Agent, or Firm* — MDIP LLC

(57) ABSTRACT

Disclosed is an emulsion aggregation toner substantially free of added colorants comprising a resin and a silicone wax of the formula

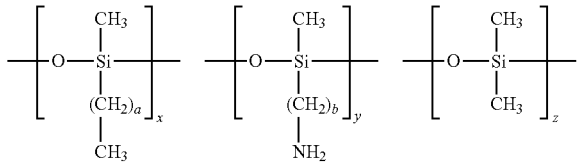

wherein the silicone wax has a weight average molecular weight of from about 5,000 to about 17,000 and a melting temperature of from about 38° C. to about 65° C.

20 Claims, No Drawings

CLEAR TONER COMPOSITION

BACKGROUND

Disclosed herein is a clear toner composition particular suitable for overcoating applications. Also disclosed herein is an image forming process using the clear toner composition.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference.

Exemplary emulsion aggregation toners include acrylate based toners, such as those based on styrene acrylate toner particles as illustrated in, for example, U.S. Pat. No. 6,120,967, the disclosure of which is totally incorporated herein by reference.

In some printing processes, a final step is employed in which a clear overcoat is applied to the print for various reasons, such as protection of the print, gloss improvement and uniformity, or the like. Various means exist for applying this overcoat, including the use of a clear toner. While known compositions and processes are suitable for their intended purposes, a need remains for improved clear overcoat toners. In addition, a need remains for overcoat toners that exhibit high gloss. Further, a need remains for overcoat toners that exhibit improved release from the fuser roll. Additionally, a need remains for overcoat toners that exhibit relatively low haze. There is also a need for overcoat toners that exhibit a high degree of transparency. There is also a need for overcoat toners with desirable flow characteristics that enable improved flow on the page that does not penetrate into the cellulose fibers and lose gloss and contributing to an even layer of toner on the page preventing irregularities in the coating. In addition, there is a need for overcoat toners that exhibit low blocking. Further, there is a need for overcoat toners that exhibit good print performance. Additionally, there is a need for overcoat toners that exhibit good flow, particle size, particle shape, and distribution of coarse and fine particles. A need also remains for overcoat toners that exhibit high gloss and transparency, enabling better photograph-like image quality.

SUMMARY

Disclosed herein is a toner comprising: (a) a resin; and (b) a silicone wax of the formula

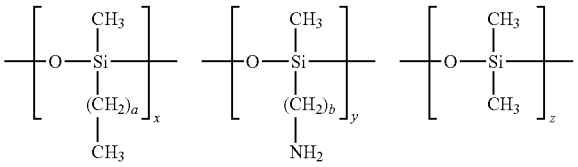

wherein: (i) a is an integer of from about 1 to about 35; and (ii) b is an integer of from about 3 to about 15; wherein the silicone wax has a weight average molecular weight of from about 5,000 to about 17,000; wherein the silicone wax has a melting temperature of from about 38° C. to about 65° C.; wherein the toner is substantially free of added colorants; and wherein the toner is an emulsion aggregation toner.

DETAILED DESCRIPTION

Disclosed herein are clear toners for overcoating toner images on substrates, such as transparency, paper, and others.

The toners are emulsion aggregation toners that can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof, and the like.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butyl acrylate-beta carboxy ethyl acrylate), and the like, as well as mixtures thereof. The polymers can be block, random, or alternating copolymers, as well as combinations thereof. In a specific embodiment, the polymer is a styrene/n-butyl acrylate/β-carboxyethyl acrylate copolymer wherein the molar ratio of monomers is from about 69 to about 90 parts styrene, from about 9 to about 30 parts n-butyl acrylate, and from about 1 to about 10 parts β-carboxyethyl acrylate, wherein the Mw value is from about 30,000 to about 40,000, and wherein the Mn value is from about 8,000 to about 15,000.

Emulsification

The emulsion to prepare emulsion aggregation particles can be prepared by any desired or effective method, such as a solventless emulsification method or phase inversion process as disclosed in, for example, U.S. Patent Publications 2007/0141494 and 2009/0208864, the disclosures of each of which are totally incorporated herein by reference. As disclosed in 2007/0141494, the process includes forming an emulsion comprising a disperse phase including a first aqueous composition and a continuous phase including molten one or more ingredients of a toner composition, wherein there is absent a toner resin solvent in the continuous phase; performing a phase inversion to create a phase inversed emulsion comprising a disperse phase including toner-sized droplets comprising the molten one or more ingredients of the toner composition and a continuous phase including a second aqueous composition; and solidifying the toner-sized droplets to result in toner particles. As disclosed in 2009/0208864, the process includes melt mixing a resin in the absence of a organic solvent, optionally adding a surfactant to the resin, optionally adding one or more additional ingredients of a toner composition to the resin, adding to the resin a basic agent and water, performing a phase inversion to create a phase inversed emulsion including a disperse phase comprising toner-sized droplets including the molten resin and the optional ingredients of the toner composition, and solidifying the toner-sized droplets to result in toner particles.

Also suitable for preparing the emulsion is the solvent flash method, as disclosed in, for example, U.S. Pat. No. 7,029,817, the disclosure of which is totally incorporated herein by reference. As disclosed therein, the process includes dissolving the resin in a water miscible organic solvent, mixing with hot water, and thereafter removing the organic solvent from the mixture by flash methods, thereby forming an emulsion of the resin in water. The solvent can be removed by distillation and recycled for future emulsifications.

Any other desired or effective emulsification process can also be used.

Toner

Toner compositions can be prepared by emulsion-aggregation processes that include aggregating a mixture of an optional colorant, an optional wax, any other desired or required additives, and emulsions including the selected resins described above, optionally in surfactants, and then coalescing the aggregate mixture. A mixture can be prepared by adding an optional colorant and optionally a wax or other materials, which can also be optionally in a dispersion(s) including a surfactant, to the emulsion, which can also be a mixture of two or more emulsions containing the resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

The toners disclosed herein contain a silicone wax. The wax is an amine-functionalized silicone wax having an alkyl chain thereon, including waxes of the general formula

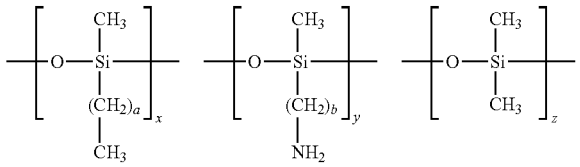

wherein:

a is an integer representing the number of repeat $CH_2$ groups, and is in one embodiment at least about 1, in another embodiment at least about 5, and in yet another embodiment at least about 10, and in one embodiment no more than about 35, in another embodiment no more than about 25, and in yet another embodiment no more than 20;

b is an integer representing the number of repeat $CH_2$ groups, and is in one embodiment at least about 3, in another embodiment at least about 5, and in yet another embodiment at least about 8, and in one embodiment no more than about 15, in another embodiment no more than about 12, and in yet another embodiment no more than about 10;

x is an integer representing the number of repeat

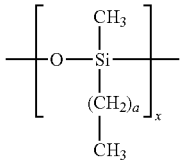

monomer units, and is in one embodiment at least about 5, in another embodiment at least about 7, and in yet another embodiment at least about 10, and in one embodiment no more than about 40, in another embodiment no more than about 30, and in yet another embodiment no more than about 25;

y is an integer representing the number of repeat

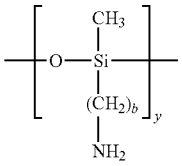

monomer units, and is in one embodiment at least about 1, in another embodiment at least about 5, and in yet another embodiment at least about 9, and in one embodiment no more than about 25, in another embodiment no more than about 20, and in yet another embodiment no more than about 15; and z is an integer representing the number of repeat

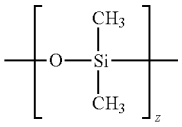

monomer units, and is in one embodiment at least about 1, in another embodiment at least about 3, and in yet another embodiment at least about 6, and in one embodiment no more than about 25, in another embodiment no more than about 20, and in yet another embodiment no more than about 15.

The wax has a weight average molecular weight of in one embodiment at least about 5,000, in another embodiment at least about 5,500, and in yet another embodiment at least about 6,000, and in one embodiment no more than about 17,000, in another embodiment no more than about 13,000, and in yet another embodiment no more than about 9,000.

The wax has a melting temperature of in one embodiment at least about 38° C., in another embodiment at least about 40° C., and in yet another embodiment at least about 43° C., and in one embodiment no more than about 65° C., in another embodiment no more than about 60° C., and in yet another embodiment no more than about 55° C.

The wax, when coated with a #26 wire wound rod onto a transparent medium (LENETA opacity charts, form 3B, 7⅝"×11⅜") and measured for % haze with a HUNTERLAB ULTRA SCAN PRO by comparing transmission measurements through an integrating sphere with specular included and specular excluded, has an L* value of in one embodiment at least about 95.32, in another embodiment at least about 95.35, and in yet another embodiment at least about 95.45, and in one embodiment no more than about 95.85, in another embodiment no more than about 95.80, and in yet another embodiment no more than about 95.65. This same sample has an a* value of in one embodiment at least about 0.01, in another embodiment at least about 0.02, and in yet another embodiment at least about 0.04, and in one embodiment no more than about 0.30, in another embodiment no more than about 0.25, and in yet another embodiment no more than about 0.20. This same sample has a b* value of in one embodiment at least about 0.30 in another embodiment at least about 0.40, and in yet another embodiment at least about 0.50, and in one embodiment no more than about 1.20, in another embodiment no more than about 1.10, and in yet another embodiment no more than about 0.90. This same sample has a C* value of in one embodiment at least about 0.30, in another embodiment at least about 0.40, and in yet another embodiment at least about 0.50, and in one embodiment no more than about 1.25, in another embodiment no more than about 1.20, and in yet another embodiment no more than about 1.15. This same sample has an h* value of in one embodiment at least about 79.20, in another embodiment at least about 79.40, and in yet another embodiment at least about 79.50, and in one embodiment no more than about 89.00, in another embodiment no more than about 88.50, and in yet another embodiment no more than about 88.00.

The wax, when coated with a #26 wire wound rod onto a transparent medium (LENETA opacity charts, form 3B, 7⅝"×11⅜") and measured for % haze with a HUNTERLAB ULTRA SCAN PRO by comparing transmission measurements through an integrating sphere with specular included and specular excluded, exhibits a percent haze value of in one embodiment at least about 0.1, in another embodiment at least about 0.4, and in yet another embodiment at least about 0.5, and in one embodiment no more than about 9, in another embodiment no more than about 8, and in yet another embodiment no more than about 5. This same sample has an a* value of in one embodiment at least about −0.02, in another embodiment at least about 0.02, and in yet another embodiment at least about 0.95, and in one embodiment no more than about 1.95, in another embodiment no more than about 1.50, and in yet another embodiment no more than about 1.00.

Transparency

The toners disclosed herein are substantially free of colorants. The CIE L*a*b* coordinates of a color indicate its lightness or darkness (wherein L*=0 indicates black and L*=100 indicates white) and its hue (wherein a* indicates position on the red/magenta and green scale, with negative values indicating green and positive values indicating magenta, and wherein b* indicates position on the blue and yellow scale, with negative values indicating blue and positive values indicating yellow). C* is a measure of chroma, or the vividness of a color; in graph representation terms the value is a representation of how far the color is from the origin point of 0,0. h* is hue, known as the degree to which a stimulus can be described as similar to or different from stimuli that are described as red, green, blue and yellow (also known as a "pure" color, one without tint or shade). A 0.45 gram per square centimeter sample of toner as disclosed herein, when suspended in solution, filtered out onto a 0.22 μm white nitrocellulose membrane (Millipore #GSWP04700), dried, and then fused in a fusing envelope, has an L* value of in one embodiment at least about 95.32, in another embodiment at least about 95.35, and in yet another embodiment at least about 95.45, and in one embodiment no more than about 95.85, in another embodiment no more than about 95.80, and in yet another embodiment no more than about 95.65. This same sample has an a* value of in one embodiment at least about 0.01, in another embodiment at least about 0.02, and in yet another embodiment at least about 0.04, and in one embodiment no more than about 0.30, in another embodiment no more than about 0.25, and in yet another embodiment no more than about 0.20. This same sample has a b* value of in one embodiment at least about 0.30, in another embodiment at least about 0.40, and in yet another embodiment at least about 0.50, and in one embodiment no more than about 1.20, in another embodiment no more than about 1.10, and in yet another embodiment no more than about 0.90. This same sample has a C* value of in one embodiment at least about 0.30, in another embodiment at least about 0.40, and in yet another embodiment at least about 0.50, and in one embodiment no more than about 1.25, in another embodiment no more than about 1.20, and in yet another embodiment no more than about 1.15. This same sample has an h* value of in one embodiment at least about 79.20, in another embodiment at least about 79.40, and in yet another embodiment at least about 79.50, and in one embodiment no more than about 89.00, in another embodiment no more than about 88.50, and in yet another embodiment no more than about 88.00.

This same sample exhibits a percent haze value of in one embodiment at least about 0.1, in another embodiment at least about 0.4, and in yet another embodiment at least about 0.5, and in one embodiment no more than about 9, in another embodiment no more than about 8, and in yet another embodiment no more than about 5. This same sample has an a* value of in one embodiment at least about −0.02, in another embodiment at least about 0.02, and in yet another embodiment at least about 0.95, and in one embodiment no more than about 1.95, in another embodiment no more than about 1.50, and in yet another embodiment no more than about 1.00.

Toner Preparation

The pH of the resulting mixture can be adjusted by an acid, such as acetic acid, nitric acid, or the like. In specific embodiments, the pH of the mixture can be adjusted to from about 2 to about 4.5. Additionally, if desired, the mixture can be homogenized. If the mixture is homogenized, homogenization can be performed by mixing at from about 600 to about 4,000 revolutions per minute. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1 percent by weight, in another embodiment at least about 0.2 percent by weight, and in yet another embodiment at least about 0.5 percent by weight, and in one embodiment no more than about 8 percent by weight, and in another embodiment no more than about 5 percent weight of the resin in the mixture.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with a Coulter Counter, for average particle size. Aggregation can thus proceed by maintaining the elevated temperature, or by slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

Shell Formation

A shell can then be applied to the formed aggregated toner particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates. In one specific embodiment, an amorphous polyester can be used to form a shell over the aggregates to form toner particles having a core-shell configuration.

In one specific embodiment, the shell comprises the same amorphous resin or resins that are found in the core. For example, if the core comprises one, two, or more amorphous resins and one, two, or more crystalline resins, in this embodiment the shell will comprise the same amorphous resin or mixture of amorphous resins found in the core. In some embodiments, the ratio of the amorphous resins can be different in the core than in the shell.

Once the desired final size of the toner particles is achieved, the pH of the mixture can be adjusted with a base to a value in one embodiment of from about 6 to about 10, and in another embodiment of from about 6.2 to about 7. The adjustment of the pH can be used to freeze, that is to stop, toner growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts from about 2 to about 25 percent by weight of the mixture, and in more specific embodiments from about 4 to about 10 percent by weight of the mixture.

Coalescence

Following aggregation to the desired particle size, with the formation of the shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C., which can be below the melting point of the crystalline resin to prevent plasticization. Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours.

After coalescence, the mixture can be cooled to room temperature, typically from about 20° C. to about 25° C. The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

The toner particles can be formulated into a developer composition. The toner particles can be mixed with carrier particles to achieve a two-component developer composition. The toner concentration in the developer can be of any desired or effective concentration, in one embodiment at least about 1 percent, and in another embodiment at least about 2 percent, and in one embodiment no more than about 25 percent, and in another embodiment no more than about 15 percent by weight of the total weight of the developer.

The toner particles have a circularity of in one embodiment at least about 0.945, in another embodiment at least about 0.950, and in yet another embodiment at least about 0.965, and in one embodiment no more than about 0.990, in another embodiment no more than about 0.985, and in yet another embodiment no more than about 0.980. A circularity of 1.000 indicates a completely circular sphere. Circularity can be measured with, for example, a Sysmex FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.14, in another embodiment at least about 1.15, and in yet another embodiment at least about 1.16, and in one embodiment no more than about 1.23, in another embodiment no more than about 1.21, and in yet another embodiment no more than about 1.19.

The toner particles can have a volume average diameter (also referred to as "volume average particle diameter" or "$D_{50v}$") of in one embodiment at least about 5.65 μm, in another embodiment at least about 5.75 μm, and in yet another embodiment at least about 5.90 μm, and in one embodiment no more than about 8.5 μm, in another embodiment no more than about 8.0 μm, and in yet another embodiment no more than about 7.5 μm. $D_{50v}$, GSDv, and GSDn can be determined using a measuring instrument such as a Beckman Coulter Multisizer 3, operated in accordance with the manufacturer's instructions. Representative sampling can occur as follows: a small amount of toner sample, about 1 gram, can be obtained and filtered through a 25 micrometer screen, then put in isotonic solution to obtain a concentration of about 10%, with the sample then run in a Beckman Coulter Multisizer 3.

The toner particles can have a shape factor of in one embodiment at least about 0.940, in another embodiment at least about 0.950, and in yet another embodiment at least about 0.960, and in one embodiment no more than about 0.990, in another embodiment no more than about 0.980, and in yet another embodiment no more than about 0.970, SF1*a.

The characteristics of the toner particles may be determined by any suitable technique and apparatus and are not limited to the instruments and techniques indicated hereinabove.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C.

In one specific embodiment, the toner particles are applied to the substrate via a single component development process. In single component development, the charge on the toner is what controls the development process. Donor roll materials are selected to generate a charge of the right polarity on the toner when the toner is brought in contact with the roll. The toner layer formed on the donor roll by electrostatic forces is passed through a charging zone, specifically in this application a charging roller, before entering the development zone. Light pressure in the development nip produces a toner layer of the desired thickness on the roll as it enters the development zone. This charging typically will be for only a few seconds, minimizing the charge on the toner. An additional bias is then applied to the toner, allowing for further development and movement of the controlled portion of toner to the photoreceptor. The image is then transferred from the photoreceptor to an image receiving substrate, which transfer may be direct or indirect via an intermediate transfer member, and then the image is fused to the image receiving substrate, for example by application of heat and/or pressure, such as with a heated fuser roll.

Single component development processes are known. The toners as disclosed herein can be used in known single component development methods, such as, for example, those disclosed in U.S. Pat. No. 5,738,966, the disclosure of which is totally incorporated herein by reference.

In one embodiment, overcoats are applied substantially uniformly to the entire surface of the substrate to which an image has been applied. In another embodiment, overcoats are applied selectively only to areas where toner images have been applied to the substrate.

Overcoated images generated with the toners disclosed herein on XEROX® 4200 paper exhibit a gloss value in Gardner gloss units (ggu) of in one embodiment at least about 15 ggu, in another embodiment at least about 25 ggu, and in yet another embodiment at least about 35 ggu, and in one embodiment no more than about 95 ggu, in another embodiment no more than about 90 ggu, and in yet another embodiment no more than about 85 ggu.

"Transparency" and "transparent," as used herein, refer to the property of a toner or substrate that transmits rays of light through its substance with sufficiently little scattering that bodies situated beyond or behind can be distinctly seen.

In one embodiment, the toners disclosed herein can be used in a development process which comprises first forming an electrostatic latent image on an imaging member and developing the image with a colored single component developer (i.e., a toner free of carrier particles). When the image is a multicolor image, a number of colored toners (typically up to four) are applied to the imaging member and then transferred to the image substrate (i.e., paper, transparency material, or the like). Thereafter, the overcoat image is formed and developed on the imaging member and the developed overcoat image is transferred to the substrate. The entire image is then fused or fixed thereto.

Any suitable substrate or recording sheet can be employed, including plain papers such as XEROX® 4024 papers, XEROX® Image Series papers, Courtland 4024 DP paper, ruled notebook paper, bond paper, silica coated papers such as Sharp Company silica coated paper, JuJo paper, HAMMERMILL LASERPRINT® paper, and the like, glossy coated papers such as XEROX® Digital Color Gloss, Sappi Warren Papers LUSTROGLOSS®, and the like, transparency materials, fabrics, textile products, plastics, polymeric films, inorganic substrates such as metals and wood, and the like.

Specific embodiments will now be described in detail. These examples are intended to be illustrative, and the claims are not limited to the materials, conditions, or process parameters set forth in these embodiments. All parts and percentages are by weight unless otherwise indicated.

Example I

Toners were made containing either no wax, paraffin wax in various amounts, or a silicone wax as disclosed herein in various amounts. 55 parts of deionized water, 27 parts polystyrene/n-butylacrylate latex having a weight average molecular weight of 30,000-38,000, either a paraffin wax (molecular weight 527, melt temperature 76° C.) in the amount shown in the table below or 5 parts silicone wax (weight average molecular weight 17,000, melt temperature 65° C.), and 0.2 parts aggregating agent (polyaluminum chloride) were charged into a reactor and homogenized with high sheer at 4000 rpm for 20 minutes. The mixture was then mixed at 350 rpm with a 4 inch A200 impeller with 45 degree angle 1 to 2 inches off the reactor bottom while heating to 55 to 60° C. The mixture was heated until the desired particle size of $D_{50}$=5.6-5.9 μm was reached, after which a higher Tg shell (12 parts poly(styrene/n-butylacrylate), Tg=59° C.) was added to the aggregate to mitigate any core charging and improve blocking. Once grown to the particle size of 7 μm with a circularity of 0.980, 3 parts of a chelator was added to the aggregate, after which a base was added to increase the pH and freeze the particle size. Once frozen, the aggregated mixture temperature was increased to 96° C. for a period of 2 h until the circularity of 0.9655 to 0.980 had been achieved (as measured by a Sysmex 3000). Once circularity was reached the mixture was cooled to 60-65° C., base adjusted to pH 8-9, and further cooled. Once cooled the product was sieved, washed, and dried to produce dry toner particles. These particles were then blended with 0.5-1.0% 40 nm fumed silica particles surface treated with polydimethylsiloxane, 0.8-1.3% 150 nm colloidal sol gel silica particles surface treated with hexamethyl disilane, 1.2-2% 40 nm fumed silica particles surface treated with hexamethyl disilane, 0.05-0.5% 8 nm fumed silica particles surface treated with hexamethyl disilane, and 0.01-0.5% 500 nm polymethylmethacrylate spacer particles. The toner was then placed into a four color LED non-magnetic, single component development printer and printed on XEROX® 4200 paper.

The tables below provide measurement data for: in Table 1, the toner containing no wax; in Table 2, the toner containing 8 parts paraffin wax; in Table 3, the toner containing 12 parts paraffin wax; in Table 4, the toner containing no wax; in Table 5, the toner containing 5 parts paraffin wax; and in Table 6, the toner containing 5 parts silicone wax. The tables report data for lightness/darkness (L*), yellow/blue color space (a*), green/red color space (b*), chroma (C*), hue (h*), toner mass area (TMA) reported as a percentage (0.5=50%, 1.0=100%, etc.), % haze, measured on a HUNTERLAB ULTRA SCAN PRO, wherein percent haze is calculated by comparing the transmission measurements through and integrating sphere with specular included and specular excluded, and ΔE2000, comparing the L*, a*, and b* values obtained by an X-RITE 939 color spectrophotometer. Delta E takes the non-wax control and compares it to the samples containing the wax. This measures the color difference between the samples and the non-wax control. The dE2000 is the most accurate measure of delta E and showed that there was not a large ΔE with the samples, making any color contained in the samples low in perceptibility to the human eye.

Toner mass area (TMA) was measured by dispersing the toner particle sample into water at a specific concentration and then filtering the sample through a 0.1 μm cellulose filter until 0.5 TMA was deposited. This filter was then dried and the sample placed onto a LENETA opacity chart section (7⅝"×11⅜"; 60.36 g sheet). The sample was inserted into a transparency envelope and fed into a fuser at a temperature that was able to tack the sample onto the transparency. The filter paper was then peeled off from the transparency. Once the sample had been transferred successfully, it was inserted into another transparency envelope and refused at a higher temp to affix it permanently.

The first three samples were measured at two TMAs, 0.5 and 1.00, measured twice for verification. It was found that the ΔE for the TMA=0.5 samples was less than 1, making the color barely perceptible to the human eye. This enabled better examination of the % haze of the samples. New samples were then measured with the optimized toner particle formulation ten times for reproducibility comparing 0% wax, 5% silicone wax, and 5% paraffin wax. The sample with the silicone wax showed that the % haze was nearly ⅓ of the paraffin wax sample.

TABLE 1

| no wax | | | | | | |
|---|---|---|---|---|---|---|
| L* | a* | b* | C* | h* | TMA | % haze |
| 95.65 | 0.04 | 0.55 | 0.55 | 85.83 | 0.50 | 1.80 |
| 95.80 | 0.02 | 0.40 | 0.40 | 87.41 | 0.50 | 1.90 |
| 95.85 | 0.01 | 0.42 | 0.42 | 88.03 | 1.00 | 1.60 |
| 95.80 | 0.02 | 0.44 | 0.44 | 87.88 | 1.00 | 1.90 |

TABLE 2

| 8 parts paraffin wax | | | | | | | |
|---|---|---|---|---|---|---|---|
| L* | a* | b* | C* | h* | TMA | % haze | $\Delta E_{2000}$ |
| 94.89 | 0.11 | 0.79 | 0.80 | 82.27 | 0.50 | 19.10 | 0.52 |
| 94.99 | 0.09 | 0.66 | 0.67 | 81.88 | 0.50 | 19.40 | 0.56 |
| 94.06 | 0.17 | 1.02 | 1.04 | 80.50 | 1.00 | 35.40 | 1.24 |
| 94.14 | 0.15 | 0.95 | 0.96 | 81.01 | 1.00 | 35.00 | 1.13 |

TABLE 3

| 12 parts paraffin wax | | | | | | | |
|---|---|---|---|---|---|---|---|
| L* | a* | b* | C* | h* | TMA | % haze | $\Delta E_{2000}$ |
| 94.77 | 0.09 | 0.74 | 0.75 | 83.03 | 0.50 | 25.90 | 0.56 |
| 94.61 | 0.13 | 0.86 | 0.87 | 81.71 | 0.50 | 26.50 | 0.85 |
| 93.27 | 0.22 | 1.20 | 1.22 | 79.40 | 1.00 | 49.60 | 1.75 |
| 93.54 | 0.21 | 1.11 | 1.13 | 79.37 | 1.00 | 46.50 | 1.53 |

TABLE 4

| no wax | | | | | | |
|---|---|---|---|---|---|---|
| L* | a* | b* | C* | h* | TMA | % haze |
| 95.67 | 0.03 | 0.49 | 0.49 | 86.87 | 0.50 | 1.80 |
| 95.53 | 0.04 | 0.53 | 0.53 | 85.30 | 0.50 | 2.30 |
| 95.68 | 0.01 | 0.39 | 0.39 | 88.43 | 0.50 | 2.60 |
| 95.45 | 0.04 | 0.51 | 0.51 | 86.05 | 0.50 | 3.10 |
| 95.60 | 0.01 | 0.42 | 0.42 | 88.06 | 0.50 | 3.40 |

TABLE 4-continued

| no wax | | | | | | |
|---|---|---|---|---|---|---|
| L* | a* | b* | C* | h* | TMA | % haze |
| 95.56 | 0.03 | 0.46 | 0.42 | 86.66 | 0.50 | 3.20 |
| 95.62 | 0.02 | 0.46 | 0.46 | 86.93 | 0.50 | 2.60 |
| 95.57 | 0.03 | 0.43 | 0.43 | 85.44 | 0.50 | 2.70 |
| 95.49 | 0.03 | 0.52 | 0.52 | 86.64 | 0.50 | 2.80 |
| | | | Average: | | | 2.72 ± 0.68 |

TABLE 5

| 5 parts paraffin wax | | | | | | |
|---|---|---|---|---|---|---|
| L* | a* | b* | C* | h* | TMA | % haze |
| 99.51 | 0.05 | 0.44 | 0.45 | 83.92 | 0.50 | 14.90 |
| 99.44 | 0.07 | 0.48 | 0.49 | 81.56 | 0.50 | 15.00 |
| 99.42 | 0.06 | 0.47 | 0.47 | 82.60 | 0.50 | 14.80 |
| 99.49 | 0.06 | 0.47 | 0.48 | 82.70 | 0.50 | 14.40 |
| 99.51 | 0.05 | 0.43 | 0.44 | 83.16 | 0.50 | 14.30 |
| 99.40 | 0.07 | 0.61 | 0.61 | 83.82 | 0.50 | 13.40 |
| 99.25 | 0.05 | 0.76 | 0.76 | 86.18 | 0.50 | 13.90 |
| 99.57 | 0.07 | 0.57 | 0.57 | 82.77 | 0.50 | 13.50 |
| 99.71 | 0.04 | 0.47 | 0.47 | 84.62 | 0.50 | 13.30 |
| | | | Average: | | | 14.17 ± 0.83 |

TABLE 6

| 5 parts silicone wax | | | | | | |
|---|---|---|---|---|---|---|
| L* | a* | b* | C* | h* | TMA | % haze |
| 95.33 | 0.03 | 0.62 | 0.62 | 87.11 | 0.50 | 6.00 |
| 95.55 | 0.03 | 0.51 | 0.51 | 86.58 | 0.50 | 5.50 |
| 95.56 | 0.03 | 0.55 | 0.55 | 86.43 | 0.50 | 5.10 |
| 95.51 | 0.02 | 0.51 | 0.51 | 87.85 | 0.50 | 5.90 |
| 95.35 | 0.05 | 0.64 | 0.64 | 85.86 | 0.50 | 6.00 |
| 95.45 | 0.03 | 0.53 | 0.53 | 86.78 | 0.50 | 6.10 |
| 95.60 | 0.04 | 0.55 | 0.55 | 86.16 | 0.50 | 4.30 |
| 95.30 | 0.05 | 0.66 | 0.66 | 85.86 | 0.50 | 6.30 |
| 95.44 | 0.02 | 0.52 | 0.52 | 87.68 | 0.50 | 6.50 |
| 95.32 | 0.04 | 0.68 | 0.68 | 86.36 | 0.50 | 5.80 |
| | | | Average: | | | 5.75 ± 0.75 |

The shift in % haze is noticeably different between the toner containing 5 parts paraffin wax and the toner containing 5 parts silicone wax, with a 10 percent reduction in haze being noted. This improvement is also noted in overcoat clarity and glossiness. Gloss on this low melt, low haze toner containing silicone wax was greater than 90 Gardner gloss units.

Example II

Three silicone wax samples were coated onto a LENETA opacity chart (7⅝"×11⅜"; 60.36 g sheet) with a #26 wire wound rod and air dried. The samples were as follows:

1: of the formula

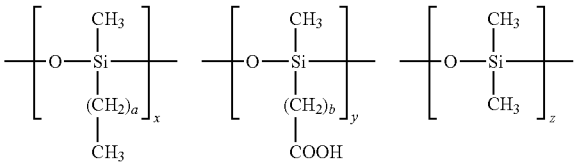

wherein a is about 34, b is 15, x is 7, y is 1, and z is 3, acid value 12.6, having a melt temperature of about 65° C. and Mw of about 17,000, obtained from Genesee Polymers as GP-955.

2: of the formula

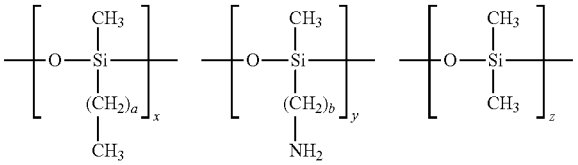

wherein a is about 17, b is 3, x is 25, y is 1, and z is 1, amine value 5.8, having a melt temperature of about 38 to 43° C. and Mw of about 8,500, obtained from Genesee Polymers as GP-7105E (2a) and GP 24-LS (2b).

3: of the formula

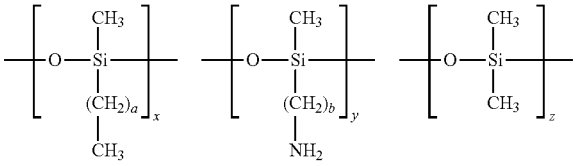

wherein a is 1, b is 3, x is 39, y is 1, and z is 1, amine value 3.8, having a melt temperature of about 38 to 43° C. and Mw of about 5,500, obtained from Genesee Polymers as GP-7104E (3a) and EXP-24-LS (3b).

The table below reports data for lightness/darkness (L*), yellow/blue color space (a*), green/red color space (b*), chroma (C*), hue (h*) as measured with an X-RITE 939 color spectrophotometer.

| Sample | L* | a* | b* | C* | h* | % haze |
|---|---|---|---|---|---|---|
| 1 | 92.80 | 0.33 | 1.71 | 1.74 | 79.18 | 78.30 |
| 2a | 94.69 | 0.35 | 2.00 | 2.03 | 80.15 | 5.50 |
| 2b | 94.30 | 0.30 | 1.72 | 1.75 | 80.00 | 8.90 |
| 3a | 94.35 | 0.29 | 1.93 | 1.95 | 81.34 | 5.80 |
| 3b | 93.33 | 0.47 | 2.22 | 2.27 | 78.02 | 10.70 |

As the data indicate, the silicone polymer having the higher molecular weight and melting point exhibited significantly higher haze compared to the two silicone polymers having the lower molecular weights and melting points.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A toner comprising:

(a) a resin; and (b) a silicone wax of the formula

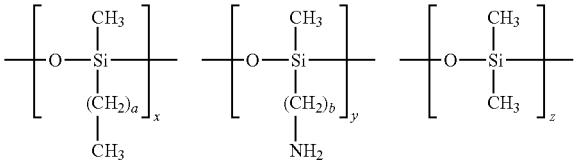

wherein:

(i) a is an integer of from about 1 to about 35; and (ii) b is an integer of from about 3 to about 15;

wherein x is an integer of no more than about 40, y is an integer of no more than about 25 and z is an integer of no more than about 25; and wherein the silicone wax has a weight average molecular weight of from about 5,000 to about 17,000;

wherein the silicone wax has a melting temperature of from about 38° C. to about 65° C.;

wherein the toner is substantially free of added colorants; and wherein the toner is an emulsion aggregation toner.

2. A toner according to claim 1 wherein the resin comprises a styrene-butyl acrylate copolymer.

3. A toner according to claim wherein the resin comprises a poly(styrene-butyl acrylate-beta carboxy ethyl acrylate).

4. A toner according to claim 3 wherein:

(a) the molar ratio of monomers is from about 69 to about 90 parts styrene, from about 9 to about 30 parts n-butyl acrylate, and from about 1 to about 10 parts β-carboxy-ethyl acrylate;

(b) the Mw value is from about 30,000 to about 40,000; and (c) the Mn value is from about 8,000 to about 15,000.

5. A toner according to claim 1 wherein the toner is encapsulated by a shell.

6. A toner according to claim 1 wherein the silicone wax has:

(a) a C* value of from about 0.30 to about 1.25;

(b) an L* value of from about 95.32 to about 95.85;

(c) an a* value of from about 0.01 to about 0.30;

(d) a b* value of from about 0.30 to about 1.20; and (e) an h* value of from about 79.20 to about 89.00.

7. A toner according to claim 1 wherein the silicone wax has:

(a) a C* value of from about 0.40 to about 1.20;

(b) an L* value of from about 95.35 to about 95.80;

(c) an a* value of from about 0.02 to about 0.25;

(d) a b* value of from about 0.40 to about 1.10; and (e) an h* value of from about 79.40 to about 88.50.

8. A toner according to claim 1 wherein the toner has:

(a) a C* value of from about 0.30 to about 1.25;

(b) an L* value of from about 95.32 to about 95.85;

(c) an a* value of from about 0.01 to about 0.30;

(d) a b* value of from about 0.30 to about 1.20; and (e) an h* value of from about 79.20 to about 89.00.

9. A toner according to claim 1 wherein the toner has:

(a) a C* value of from about 0.40 to about 1.20;

(b) an L* value of from about 95.35 to about 95.80;

(c) an a* value of from about 0.02 to about 0.25;

(d) a b* value of from about 0.40 to about 1.10; and (e) an h* value of from about 79.40 to about 88.50.

10. A toner according: to claim 1 wherein the silicone wax has a % haze of from about 0.1 to about 9.

11. A toner according to claim 1 wherein the silicone wax has a % haze of from about 0.4 to about 8.

12. A toner according to claim 1 wherein the toner has a % haze of from about 0.1 to about 9.

13. A toner according to claim 1 wherein the toner has a % haze of from about 0.4 to about 8.

14. A toner according to claim 1 wherein the toner has a gloss value of from about 15 to about 95 ggu.

15. A toner comprising:

(a) a resin; and (b) a silicone wax of the formula

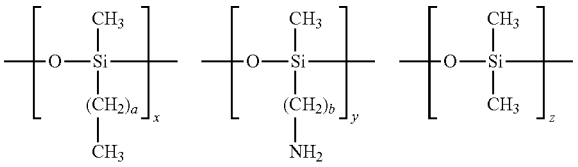

wherein:

(i) a is an integer of from about 1 to about 35; and (ii) b is an integer of from about 3 to about 15;

wherein x is an integer of no more than about 40, y is an integer of no more than about 25 and z is an integer of no more than about 25; and wherein the silicone wax has a weight average molecular weight of from about 5,500 to about 13,000;

wherein the silicone wax has a melting temperature of from about 40° C. to about 60° C.;

wherein the toner is substantially free of added colorants;

wherein the toner is an emulsion aggregation toner;

wherein the toner has a % haze of from about 0.4 to about 0.8; and wherein the toner has a gloss value of from about 35 to about 85 ggu.

16. A printed substrate comprising:

(a) a substrate;

(b) a colored toner situated in an imagewise pattern on at least one surface thereof; and (c) the toner of claim 1.

17. A printed substrate comprising;

(a) a substrate;

(b) a colored toner situated in an imagewise pattern on at least one surface thereof; and (c) the toner of claim 15.

18. A printed substrate according to claim 16 wherein the toner has:

(a) a C* value of from about 0.30 to about 1.25;

(b) an L* value of from about 95.32 to about 95.85;

(c) an a* value of from about 0.01 to about 0,30;

(d) a b* value of from about 0.30 to about 1.20; and (e) an h* value of from about 79.20 to about 89.00.

19. A printed substrate according to claim 16 wherein the toner has a % haze of from about 0.1 to about 9.

20. A printed substrate according to claim 16 wherein the toner has a gloss value of from about 15 to about 95 ggu.

* * * * *